United States Patent [19]

Elmore et al.

[11] 4,365,974

[45] Dec. 28, 1982

[54] APPARATUS FOR SOLUBILIZING AND OXIDIZING OF PEAT

[75] Inventors: Carl L. Elmore; Erwin D. Funk; Ted M. Poulin, all of Glen Falls, N.Y.

[73] Assignee: Kamyr, Inc., Glen Falls, N.Y.

[21] Appl. No.: 182,314

[22] Filed: Aug. 28, 1980

[51] Int. Cl.[3] ..... C10J 3/00

[52] U.S. Cl. ..... 48/111; 261/124; 261/153; 422/197; 422/202; 422/205; 435/167; 435/313; 435/813

[58] Field of Search ..... 48/111, 209, DIG. 7, 48/197 R, 61, 197 A; 435/166, 167, 813, 287, 313; 568/761, 762; 422/196, 197, 202, 205, 224, 231; 261/153, 124; 44/33

[56] References Cited

U.S. PATENT DOCUMENTS

| | | | |
|---|---|---|---|
| 2,293,946 | 8/1942 | Payne | 422/196 |
| 2,668,099 | 2/1954 | Cederquist | 44/33 |
| 2,987,387 | 6/1961 | Carkeek et al. | 48/197 R |
| 3,000,711 | 9/1961 | Eastman et al. | 48/63 |
| 3,097,081 | 7/1963 | Eastman et al. | 48/197 R |
| 3,388,057 | 6/1968 | Callahan | 48/197 A |
| 3,807,963 | 4/1974 | Smith | 422/205 |
| 4,162,290 | 7/1979 | Crawford et al. | 422/205 |
| 4,169,010 | 9/1979 | Marwil | 435/313 |
| 4,251,227 | 2/1981 | Othmer | 48/209 |
| 4,252,901 | 2/1981 | Fischer et al. | 435/167 |

OTHER PUBLICATIONS

Feasibility of a Peat Biogasification Process by Buivid et al.

*Primary Examiner*—S. Leon Bashore, Jr.
*Assistant Examiner*—Michael L. Goldman
*Attorney, Agent, or Firm*—Cushman, Darby & Cushman

[57] ABSTRACT

Methane is produced from peat by solubilizing the phenolic polymers therein, and oxidizing the solute to produce short chain molecules. The short chain molecules are fermented to produce a gas that this scrubbed to remove $CO_2$ to produce methane. Solubilizing takes place in a vertically oriented pressurized vessel that is circular in cross-section and divided into a number of regular vertically elongated compartments, each comprising a circular sector in cross-section, and extending the majority the height of the vessel. Slurried peat is fed into the top of one compartment while another compartment is being emptied from the bottom, the compartment being filled or emptied being progressively changed in response to rotation of a central shaft in the vessel. Oxidation of solubilized peat takes place in a structure that transports the solubilized peat in a substantially vertical wave path from an inlet to an outlet with oxygen being introduced at the bottoms of segments of the wave path, and $CO_2$ being withdrawn from the tops of segments of the wave path while the solubilized peat is maintained at a pressure above atmospheric. Coolant is circulated around the wave path to remove the exothermic heat of reaction, and the coolant is flashed into steam used elsewhere in the process.

2 Claims, 11 Drawing Figures

TO FIGURE 1b
FC
ALKALI
24
13
VENT
FILTRATE
23
PC
STORAGE POND
30
33
97
12
31
36
98
43
44
2b
2b
WATER
46
11
PEAT MINE
39
10
38
2a
2a
58
FC
TO FIGURE 1b

FROM FIGURE 1a

EXCESS STEAM
WATER
103
$CO_2$
102
107
FERMENTER
$CO_2$ SCRUBBER
$CH_4$
109
99
PC
LC
100
104
DISCHARGE
105
96
$CO_2$
82
101
BLOW DOWN
LC
95
108
66
68
69
OXYGEN
78
64
61
LC
60
COOLING WATER
63
62
ASH
FROM FIGURE 1a

Fig. 2a
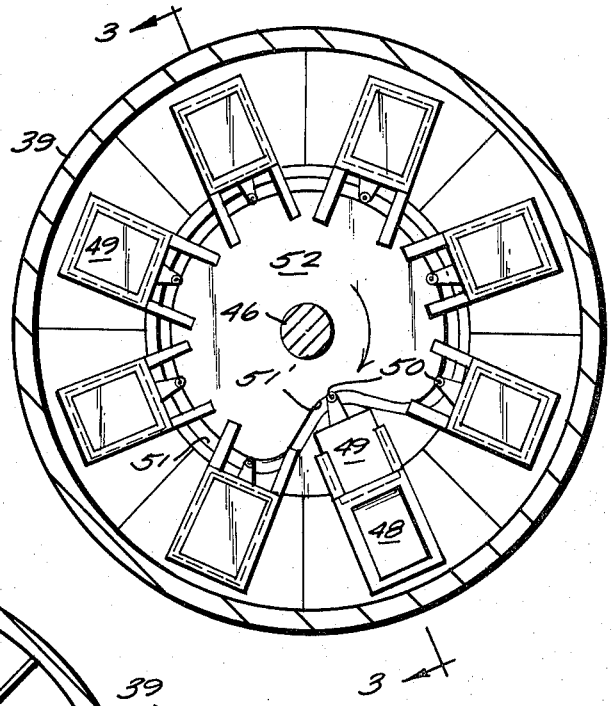
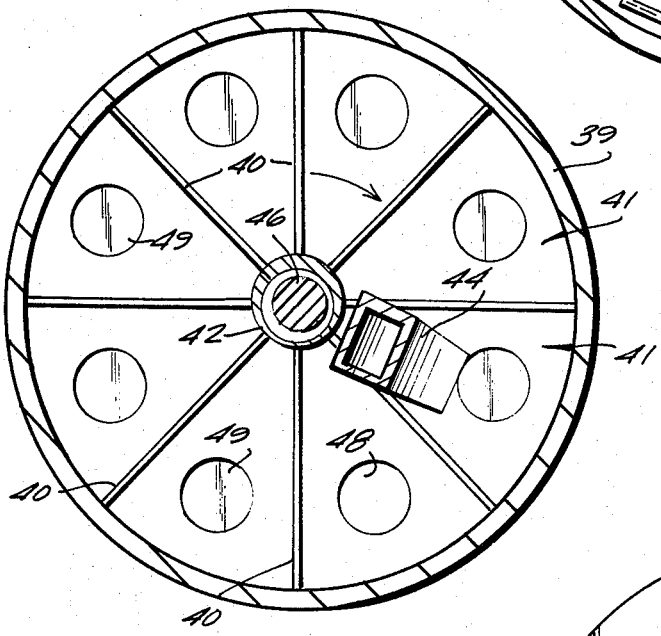
Fig. 2b
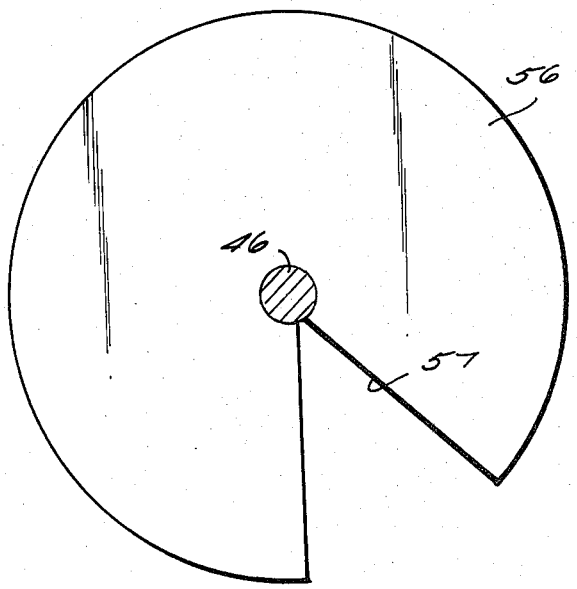
Fig. 2c

Fig. 5
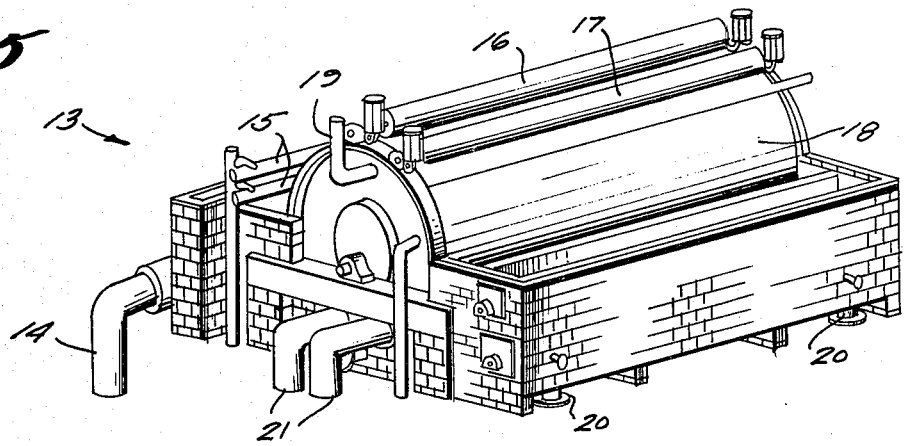
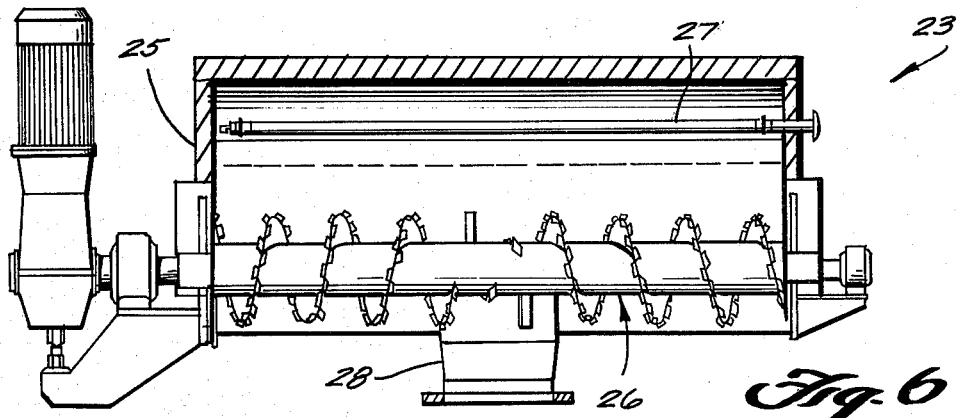
Fig. 6
Fig. 7
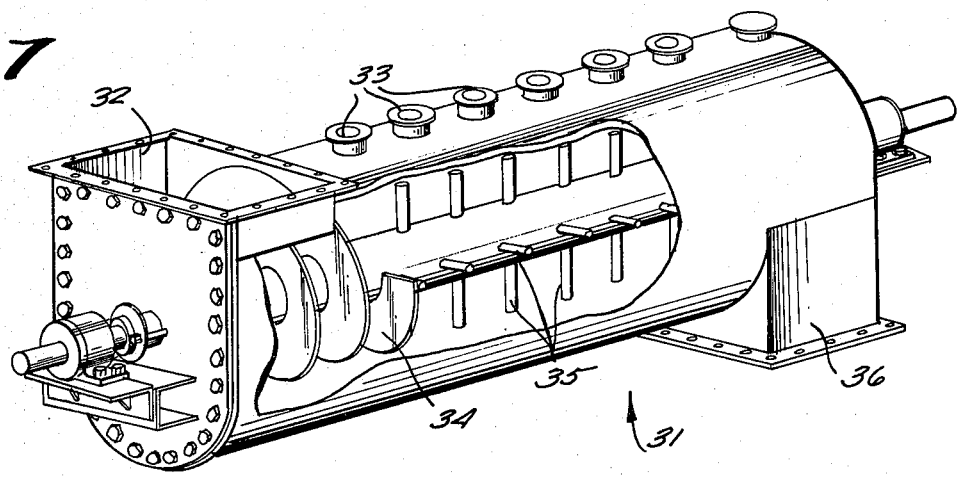

APPARATUS FOR SOLUBILIZING AND OXIDIZING OF PEAT

BACKGROUND AND SUMMARY OF THE INVENTION

The synthetic production of fuel gases, particularly methane, is an especially desirable manner of fulfilling world energy requirements. Fuel gases, particularly methane, can be transported long distances with little energy penalty, can be burned cleanly, and are extremely versatile. It has been proposed that a particularly advantageous manner of producing methane is the biogasification of peat. Peat is a very abundant resource in many parts of the world, and the production of methane from peat could provide a long-term supply of energy. For instance, in the United States the peat resources (in terms of energy content) are greater than the maximum recoverable energy from uranium, shale oil, or the combined reserves of petroleum and natural gas.

Conventional proposals for the production of methane from peat include conventional gasification and biogasification. The usual practice in conventional treatment is to gasify the peat with steam to produce CO and $H_2$. The CO and $H_2$ are then catalyzed to $CH_4$. The high moisture content (80% after pressing) of the peat produces a severe energy penalty when proceeding in this manner, since the peat must be thermally dried either outside or inside the gasifier. Prior proposals for biogasification of peat suggest an alkaline oxidation pretreatment, separation of unreacted solids, and anaerobic fermentation of the liquid containing the soluble organics. Such prior biogasification proposals are usually capable of converting to methane only about 26% of the energy value in the peat, although unreacted peat solids may be further processed as a boiler fuel.

According to the present invention there is provided a method facilitating the efficient biogasification of peat, and particular apparatus and specific method steps therefor. The present invention has advantages over prior conventional gasification and biogasification methods in that it is possible to convert over 80% of the original energy of the peat to methane, and in addition produce some by-product energy.

According to a preferred method of the present invention, the first step in the production of fuel gas (primarily methane) from peat is the slurrying of the peat, such as to a consistency of about 3 to 5%. The slurried peat is then formed to a consistency of about 10 to 25%, such as by passing it through a cylinder mould. The peak slurry then is thoroughly mixed with alkali, such as by adding NaOH to the slurry in a repulper. The peat slurry is then heated to the solubilization temperature for phenolic polymers therein while it is pressurized, preferably by intimately mixing steam with the pulp slurry in a steam mixer.

Once the peat is at solubilization temperature, it is maintained at solubilization temperature and pressure conditions for a sufficient period of time so that substantially all of the peat becomes solubilized; this is accomplished continuously by feeding the heated slurry into a vertical vessel with a plurality of circular segment compartments which are sequentially filled and emptied. Once solubilized, the peat (after unsoluble components are separated therefrom) is fed to an oxidizer where oxidation takes place. This is preferably accomplished by passing the solubilized peat in a substantially vertical wavy path while introducing oxygen at the bottoms of segments of the path and withdrawing carbon dioxide from the tops of segments of the path. The exothermic heat of reaction is removed during oxidation, and the heated water generated in this heat removal is flashed to steam to supply steam to the steam mixer, and to provide by-product energy.

After oxidation, the solubilized peat is cooled to a temperature appropriate for fermentation (e.g. about 130° to 150° F.), and is then fermented aerobically. A gas including $CO_2$ and fuel gas is produced by the fermentation process, and the $CO_2$ is scrubbed from the gas produced by fermentation to provide the final product fuel gas (methane).

One component piece of apparatus for practicing the invention that is particularly important is the solubilizer. The solubilizer includes a vertically oriented pressure vessel that is circular in cross-section. Means are provided for dividing the vessel into a plurality of regular, uninterrupted vertically elongated compartments with each compartment extending the majority of the height of the vessel and the compartments are disposed in a closed path around the circumference of the vessel (each compartment comprising substantially a circular sector in cross-section). Means are provided for progressively feeding slurried peat or the like into each of the plurality of compartments, in turn, at the top thereof, and means are provided for progressively effecting emptying of each of the plurality of compartments at the bottom thereof after a predetermined retention time within the compartment, so that as one compartment is being filled another is being emptied. Progressive feeding and emptying is preferably accomplished by a common powered shaft disposed centrally in the vessel and extending the height thereof. The shaft operates one structure at the bottoms of the compartments to effect sequential discharge from the compartments, while at the top the shaft is provided with a chute which trails the bottom-emptying structure in the direction of rotation of the shaft so that as a compartment is emptied the next compartment is being filled.

Another important component piece of apparatus comprises the oxidizer. The oxidizer includes means defining a liquid-transporting substantially vertical wave path including an inlet and outlet. Means are provided for introducing oxygen at the bottoms of segments of the wave path, and means are provided for exhausting off-gases from the tops of segments of the wave path so that the wave path is maintained above atmospheric pressure. Means are provided for circulating coolant (particularly water) around the wave path to remove the exothermic heat of reaction from solubilized peat or the like in the wave path, while preventing mixing of the coolant and solubilized peat or the like circulating in the wave path. The wave path is preferably defined by a vessel having a plurality of vertically extending baffles disposed therein, the baffles alternately extending from the top and the bottom of the vessel each to define liquid passageway past the bottom or top thereof, respectively. The coolant circulation means preferably comprise a plurality of staggered heat-exchanger tubes extending in substantially horizontal planes within the vessel.

In addition to comprising a complete method for production of methane from peat and particular apparatus components adapted to practice the method, the invention also contemplates particular substeps of the general methane production process.

It is the primary object of the present invention to provide an energy efficient process, and apparatus adapted to be utilized therein, for the biogasification of peat. This and other objects of the invention will become clear from an inspection of the detailed description of the invention and from the appended claims.

BRIEF DESCRIPTION OF THE DRAWINGS

FIGS. 2*a* and 2*b* are cross-sectional views taken along lines 2*a*—2*a* and 2*b*—2*b*, respectively, of FIG. 1*a;*

FIG. 2*c* is a top plan view of a component for emptying the solubilizer compartments that may be used in place of the structure illustrated in FIG. 2*a;*

FIG. 5 is a schematic perspective view of an exemplary conventional cylinder mould that may be utilized in practicing the process of FIGS. 1*a* and 1*b;*

FIG. 6 is a side view, partly in cross-section and partly in elevation, of an exemplary conventional repulper that may be utilized in practicing the process of FIGS. 1*a* and 1*b;* and FIG. 7 is a schematic perspective view, with portions cut away for clarity, of an exemplary conventional steam mixer that may be utilized in practicing the process of FIGS. 1*a* and 1*b.*

DETAILED DESCRIPTION OF THE DRAWINGS

Figure 1A:
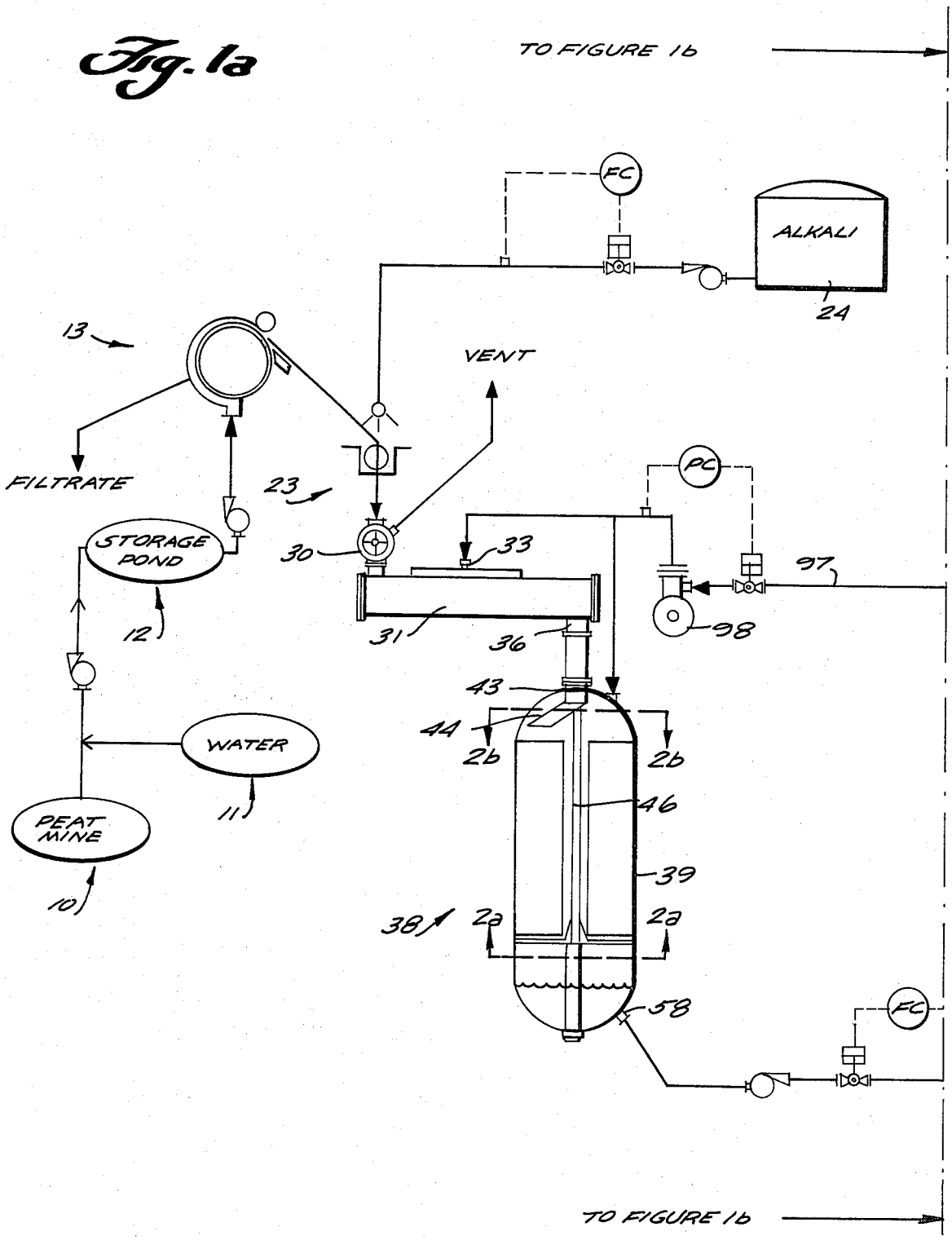
FIGS. 1*a* and 1*b* are schematic depictions of the components for an exemplary process of biogasification of peat, according to the present invention.
Figure 1B:
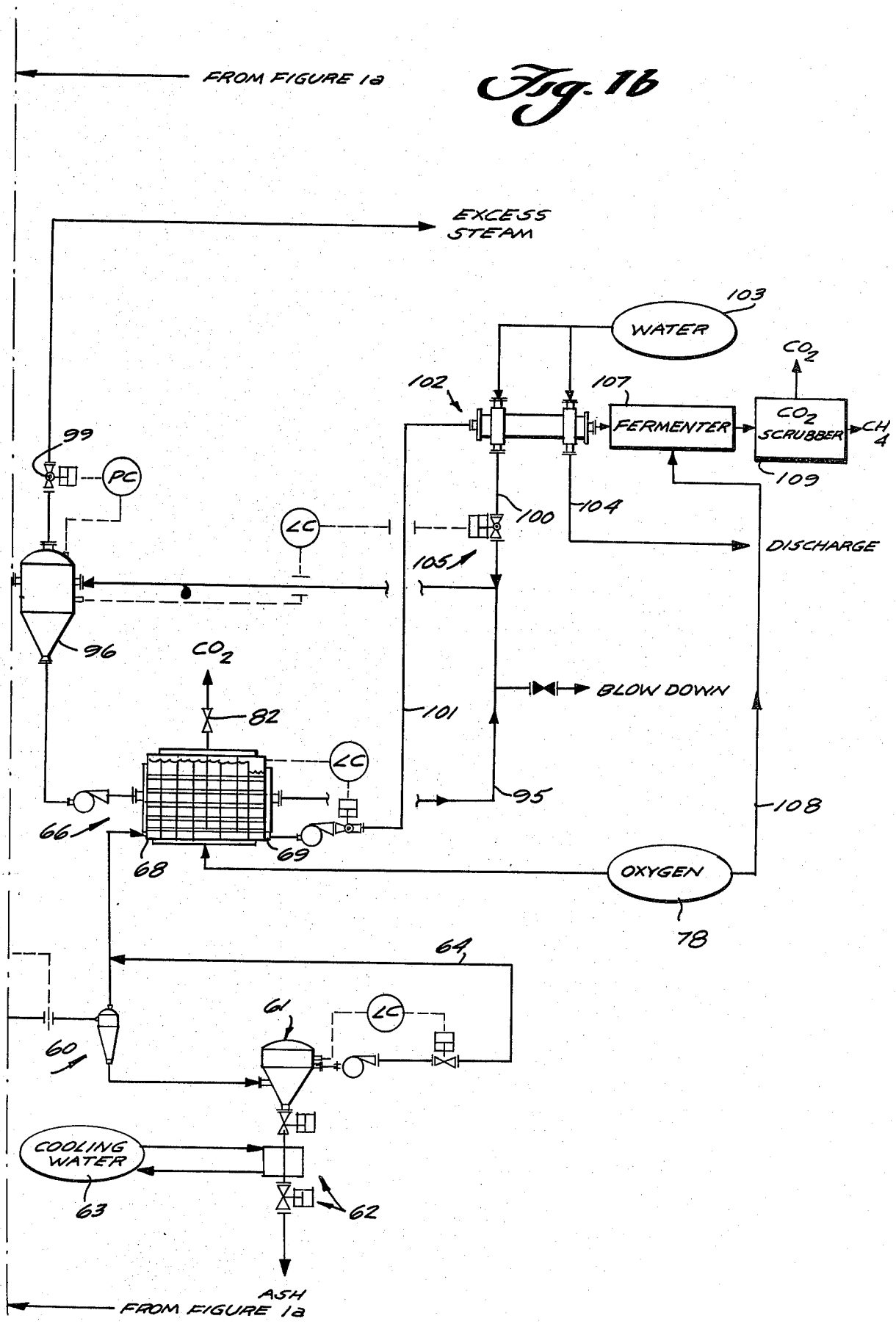

Exemplary apparatus for practicing a process for efficiently producing methane from peat is illustrated schematically in FIGS. 1*a* and 1*b*. Basically, the peat is slurried, solubilized, oxidized, and fermented to produce the desired end product.

Peat is mined at a site 10 illustrated in FIG. 1, and is slurried with water from source 11 to a preferred consistency of about 3 to 5%. The slurry may be passed to a storage pond 12 to level out surges, and ultimately is formed to a slurry having a consistency of about 10 to 25% (preferably 20 to 25%) when passed to a cylinder mould 13. An exemplary conventional cylinder mould used in the processing of wood chips is suitable for the structure 13, and such a cylinder mould is illustrated schematically in FIG. 5. The slurried peat is fed into inlet 14, subjected to a shower wash by structures 15, passed past rollers 16, 17 over cylinder 18 while a vacuum is being applied through 19 to the cylinder, and the slurry resulting is passed through outlets 20. Filtrate is withdrawn through outlets 21 for reuse. While a cylinder mould is preferred, a conventional press such as is utilized in wood chip processing may be utilized.

Once the slurry has a consistency of about 10 to 20%, it is thoroughly mixed with alkali. This is preferably accomplished by passing the slurry to a conventional repulper 23 fed by an alkali tank 24. Throughout processing of the peat, various flow controls (FC), level controls (LC), and pressure controls (PC) may be utilized.

A conventional repulper 23, such as utilized in the making of paper products from wood pulp, is illustrated most clearly in FIG. 6. The slurry introduced into housing 26 is acted upon by the toothed screw conveyor 26 to provide a more porous mass while alkali (preferably NaOH at concentrations from 25 to 50%) is sprayed by spray tube 27 fed from tank 24 onto the slurry. The alkali-mixed slurry then exits outlet 28.

From the repulper 23, the peat slurry drops by gravity into a low pressure gas lock feeder 30, such as is used conventionally in the production of paper pulp. The gas lock feeder holds pressure at the steam saturation level for the solubilizing temperature and charges the peat into a steam mixer 31. Intimate mixing of steam with the slurry in the steam mixer 31 heats the peat to the solubilization temperature for phenolic polymers therein under appropriate pressure conditions.

A conventional steam mixer, such as is used in the production of paper pulp, is illustrated schematically at 31 in FIG. 7. The slurry is introduced into inlet 32 while steam is introduced through steaming orifices 33. A conveyor 34 within the steam mixer 31 conveys the slurry while it is acted upon by paddles 35 which stir and agitate the peat to provide the intimate contact with the steam. This intimate steam contact heats the peat to temperatures in the range of 250° to 300° F. by the time it reaches outlet 36.

Once heated, the peat slurry is maintained at solubilization temperature and pressure conditions for a sufficient period of time so that substantially all of the peat becomes solubilized. This is accomplished utilizing the solubilizer 38 illustrated most clearly in FIGS. 1*a*, 2*a*, 2*b*, and 3. The solubilizer 38 includes a vertically oriented pressurized vessel 39 that is substantially circular in cross-section. Means are provided, such as the generally radially extending dividing walls 40, for dividing the vessel into a plurality of regular, uninterrupted, vertically elongated compartments 41, each compartment extending the majority of the height of the vessel 39 and the compartments disposed in a closed path around the circumference of the vessel 39. As illustrated most clearly in FIG. 2*b*, each compartment comprises substantially a circular sector in cross-section. Considering the central tube 42 (hereinafter explained), each compartment is in fact an annulus in cross-section.

Means are provided for progressively feeding slurried peat or the like into each of the compartments 41, in turn, at the top thereof. The feeding means include the inlet 43 at the top of vessel 39, and rotatable chute 44 which moves from above one compartment 41 to another. The solubilizer 38 also includes means for progressively effecting emptying of each of the compartments 41 at the bottom thereof after a predetermined retention time (typically in the range of 20 to 40 minutes) so that as one compartment is being emptied, another compartment is being filled. The vessel 39 maintains the slurry at the saturation pressure of the peat/water temperature.

Figure 3:
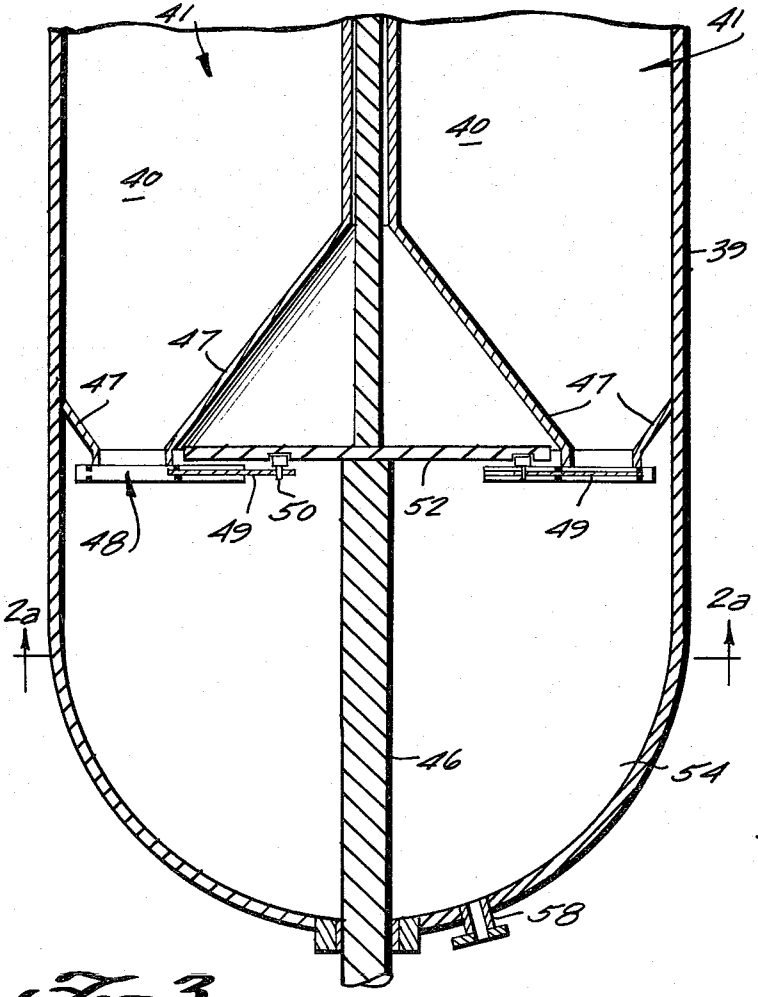
FIG. 3 is a cross-sectional view taken along lines 3—3 of FIG. 2*a;*

The means for progressively effecting emptying of each of the compartments 41 preferably comprises the structure illustrated most clearly in FIGS. 2*a*, 2*b*, and 3. A powered shaft 46 is provided, and a bottom wall 47 with a bottom opening 48 is provided for each compartment 41. A valve member is provided for opening or closing each opening 48, preferably a gate valve having a slidable valve plate 49 movable from the open position illustrated on the left-hand side of FIG. 3 to the closed position illustrated on the right-hand side of FIG. 3. Rotation of the shaft 46 is translated to linear movement of the valve plates 49 by a cam roller 50 attached to each valve plate 49 and disposed in a cam groove 51 formed in a cam plate 52 attached to (and extending perpendicularly to) the shaft 46. Relatively small seal surfaces are provided by such a valve arrangement, and the seals need not be completed liquid tight since peat that becomes liquidized can be allowed to leak through an opening 48 into the bottom chamber 54 of the vessel 39.

The shaft 46 preferably extends the height of the vessel 39 and is operatively attached to the chute 44 to also effect rotation thereof. The shaft 46 extends upwardly through the central tube 42. The chute 44 is attached to the shaft 46 so that it trails the opening manifestation 51' (see FIG. 2*a*) of the cam groove 51 in the direction of rotation of the shaft 46 by one compartment 41 (see FIG. 2*b*). The mechanism for powering the shaft 46 comprises a conventional indexing drive that—in the embodiment illustrated in the drawings—indexes one/eighth of a revolution every time it is actuated. In this way, once an opening 48 associated with a compartment 41 is unblocked by a valve plate 49 and emptied, the chute 44 is brought into operative association therewith once the valve plate 49 is again moved over the opening 48 so that the compartment is filled right after it is emptied.

Instead of providing the valving arrangement illustrated in FIGS. 2*a*, 2*b*, and 3, the bottoms of all of the compartments 41 may be maintained opened, and a disc 56 may be operatively attached to the shaft 46, as illustrated in FIG. 2*c*. The disc 56 has a circular segment cutout 57 formed therein corresponding substantially to the dimensions of one of the compartments 41 so that the disc 56 supports the peat in all the compartments 41 except the one in registry with the cutout 57, the peat dropping through the cutout 57 into the chamber 54 from that compartment.

The solubilized peat is passed through outlet 58 of vessel 39 to a structure for separating ash, roots, sand, and like insoluble particles therefrom. Preferably separation is accomplished utilizing a hydrocyclone 60. The underflow from the hydrocyclone (which contains solids) is directed to a decanter 61. The decanter 61 may be a pressurized gravity settler as illustrated in FIG. 1*b*, and refuse is removed through an ash lock 62. Cooling water can be provided from source 63. For larger sized plants, it may be desirable to provide as the decanter a pressurized decanter centrifuge with refuse therefrom passed through a low pressure gas lock feeder. After decanting, the decanted solution is pumped through line 64 to remix with solution overflowing the hydrocyclone 60.

Figure 4B:
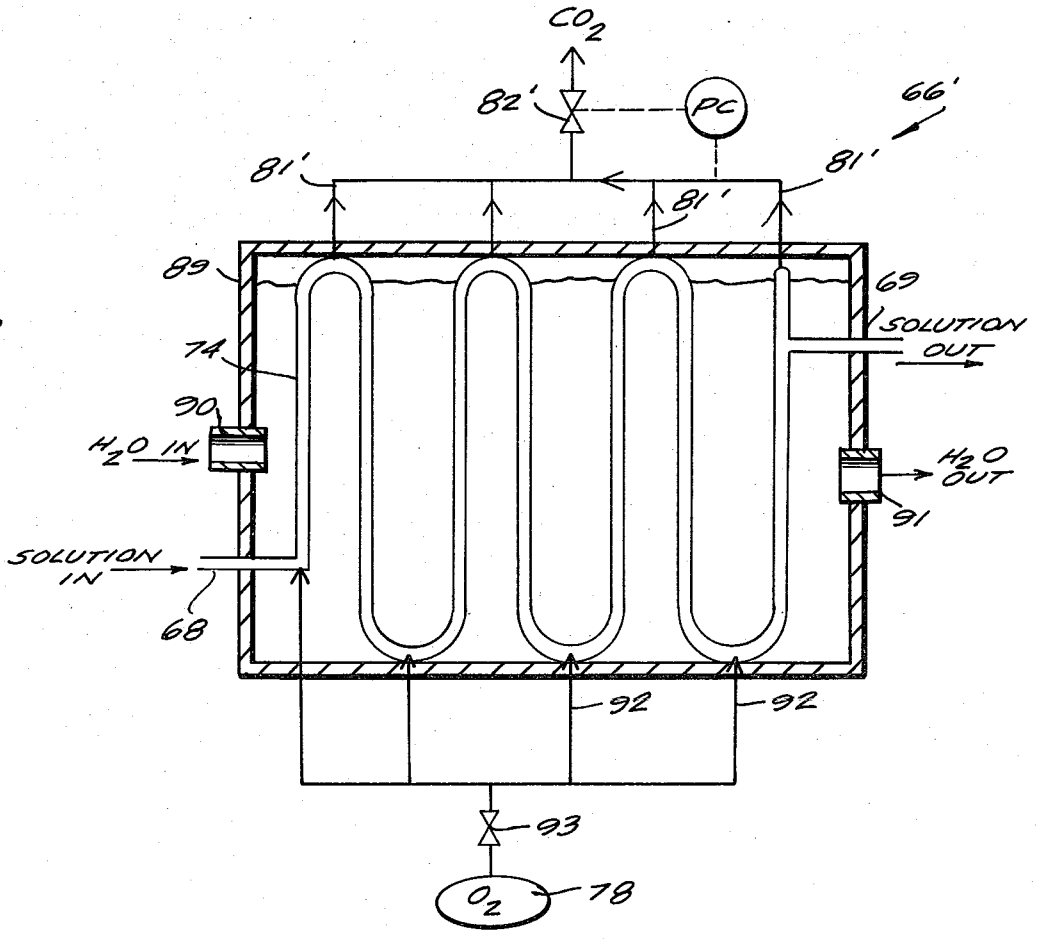
FIGS. 4*a* and 4*b* are schematic views, partly in cross-section and partly in elevation, of alternative embodiments of exemplary oxidizers according to the present invention.
Figure 4A:
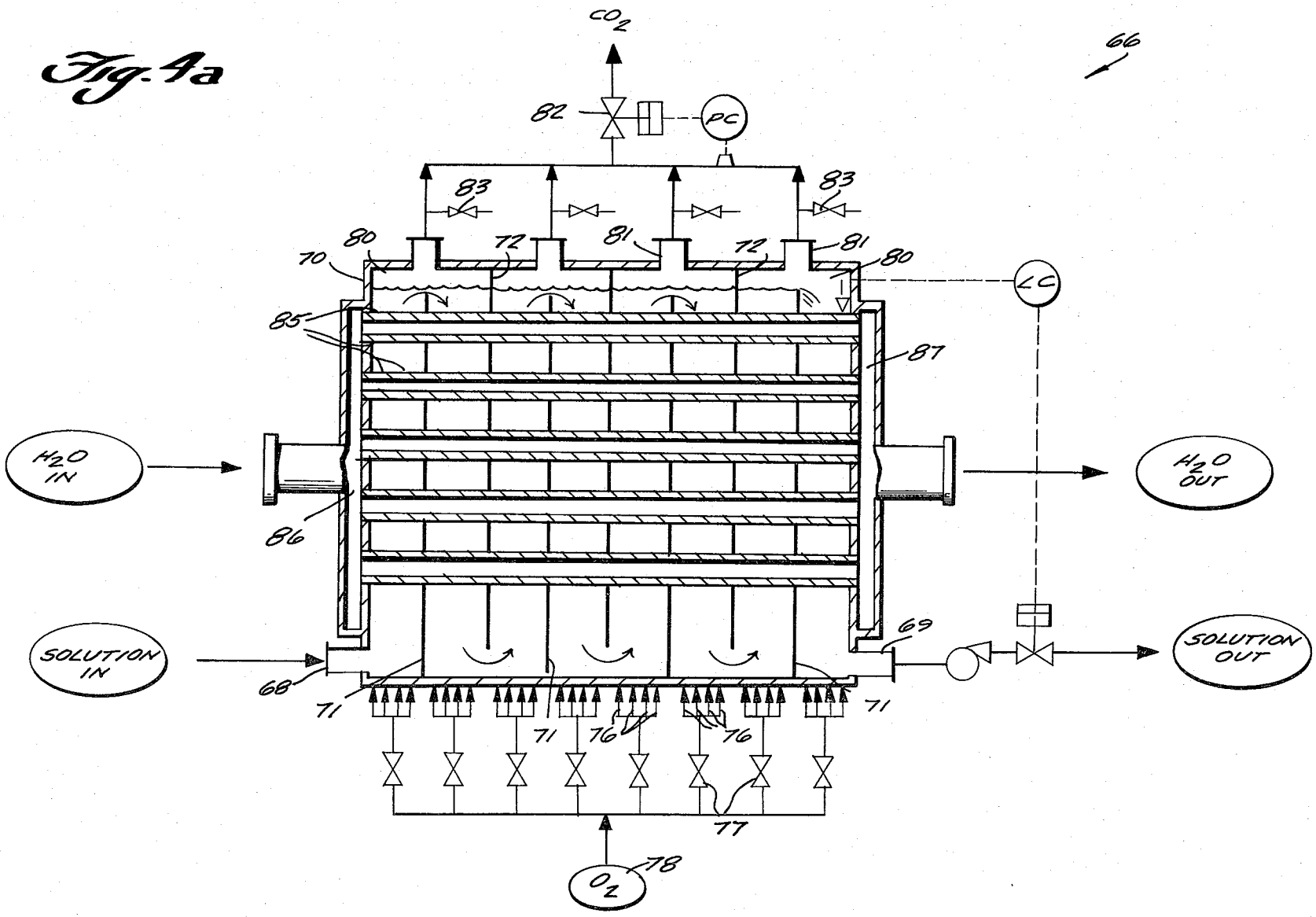

After separation of insolubles, the solubilized peat is passed to an oxidizer 66 according to the present invention. A preferred oxidizer 66 is illustrated most clearly in FIG. 4*a* while an alternative embodiment of an oxidizer (66') is illustrated most clearly in FIG. 4*b*.

The oxidizer includes means defining a liquid-transporting substantially vertical wave path from an inlet 68 to an outlet 69. For the oxidizer 66, the means defining the liquid-transporting wave path includes a vessel 70 having a plurality of vertically extending baffles disposed in the vessel, including baffles 71 extending from the bottom of the vessel to the top to define a liquid passageway past the top thereof, and the alternate baffles 72 extending from the top to the bottom of the vessel 70 to define a liquid passageway past the bottom thereof. For the oxidizer 66', the means defining the liquid-transporting substantially vertical wave path comprises a wavy pipe 74.

The oxidizer also includes means for introducing oxygen at the bottoms of segments of the wave path, means for exhausting off-gases from the tops of segments of the wave path so that the wave path is maintained above atmospheric pressure, and means for circulating coolant (e.g. water) around the wave path to remove the exothermic heat of reaction from solubilized peat or the like in the wave path, while preventing mixing of the coolant and the solubilized peat circulating in the wave path. The oxygen introduction means for the oxidizer 66 preferably includes a set of oxygen-introducing tubes 76 disposed between each set of adjacent baffles 71, 72 in the bottom of the vessel, and a flow control valve 77 operatively connected to each of the tube sets 76 into a source 78 of oxygen under pressure. For oxidizer 66 the off-gas exhausting means (primarily removing $CO_2$) comprises a head 80 provided in the volume of the vessel above each of the baffles 71, an exhaust passageway 81 extending upwardly from each head, and pressure control valve means 82 for allowing exhausting of off-gases from the heads 80 through the exhaust passageways 81 when the pressure in the heads 80 exceeds a predetermined amount. A sample valve 83 may be associated with each of the exhaust passageways 81 for withdrawing a sample of gas and analyzing it.

For the oxidizer 66, the means for circulating coolant around the wave path comprises a plurality of staggered heat-exchanger tube 85 (see FIG. 4*a*) extending in substantially horizontal planes within the vessel 70. The tubes 85 are operatively connected at one end thereof to an inlet header 86 for coolant, and at the other end thereof to an outlet header 87 for the coolant. Arranged in the manner illustrated in FIG. 4*a*, the coolant inlet 86 is on the same side of the vessel 70 as the solubilized peat inlet 68 so that coolant circulates in the same general direction as the solubilized peat so that the coolest coolant will be in heat-exchanging relationship with solubilized peat adjacent inlet 68 and the hottest coolant will be in heat-exchanging relationship with solubilized peat adjacent the outlet 69.

The coolant circulating means for the oxidizer 66' (see FIG. 4*b*) comprises a water jacket 89 surrounding the pipe 74, with a water inlet 90 and a water outlet 91 being associated with the vessel 89. For the oxidizer 66', the off-gas exhausting means comprises an exhaust tube 81' extending upwardly from the top of each segment of the wavy pipe 74, with a pressure controlled valve means 82' allowing exhausting of off-gases from the passageways 81' when the pressure in the passageways 81' exceeds a predetermined amount. The oxygen introducing means for the oxidizer 66' is provided by a conduit 92 extending through a flow control valve 93 from oxygen source 78 to each bottom portion of the pipe 74.

The oxidizers 66, 66' provide a retention time of about 3 to 5 minutes for the reaction of the solubilized peat with oxygen, with oxygen to peat ratios ranging from about 0.4 to 0.5 by weight. The exothermic reaction produces heat in the range of 1600 to 2000 BTU/lb. of peat. The heated water from coolant outlet 87 (or 91) is passed via line 95 to a flash tank 96, wherein it is flashed to steam. Some of the steam is fed through line 97 to a compressor 98 wherein it is compressed to a higher temperature equal to the solubilizer 38 reaction temperature. This higher temperature steam is injected through ports 33 into the steam mixer 31. The flash pressure from flash tank 97 is controlled by an automatic pressure regulating valve 99, the steam passing through this valve being excess steam which provides a supplemental energy source. The flash tank 96 tends to cause a loss of water from the oxidizer cooling system, and this loss is made up with fresh water from line 100.

After being oxidized in oxidizer 66, the solubilized peat passes into line 101 wherein it is pumped to a cooling heat exchanger 102. Water is circulated from source 103 to the heat exchanger 102 to reduce the temperature from the oxidation level of about 260° to 270° F. down to 130° to 150° F. (the fermentation temperature). Part of the cooling water from heat exchanger 102 is discharged through line 104, while another portion—having been preheated by the oxidized, solubilized peat, is passed into line 100 and subsequently to flash tank 96 to provide makeup water. Level controlled valve 105 controls the amount of flow through line 100.

After cooling, the solubilized, oxidized peat is passed to an aerobic fermenter 107, oxygen being supplied to the fermenter 107 from source 78 through line 108. The gases produced during fermentation include $CO_2$ and fuel gas (primarily methane) so that the gas exhausted from fermenter 107 is passed to a $CO_2$ scrubber 109 which removes the $CO_2$ from the methane product. The fermenter 107 and scrubber 109 may be of conventional design, and appropriate microorganisms for effecting fermentation in the fermenter 107 include species *Moraxelia* and *Rhodopseudomonas Palustria.*

Utilizing the apparatus illustrated in FIGS. 1*a* and 1*b* in the method of producing methane from peat according to the present invention, it is possible to transform over 80% (e.g. 82%) of the original energy of the peat into methane. This is accomplished without the introduction of any extrinsic energy, and in fact is accomplished with some by-product energy preferably in the form of excess steam, which may be used to drive a generator and produce electricity for powering pumps, centrifugal cleaners, and the like. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Apparatus for producing a fuel gas from slurried peat and the like, comprising: a cylinder mould for forming the slurried peat or the like to a desired consistency; a repulper operatively connected to said cylinder mould for mixing alkali with the slurry; a steam mixer connected to said repulper for heating the slurry to solubilization temperature for phenolic polymers therein, while pressurizing it;

a solubilizer comprising a vertically oriented pressure vessel divided into a plurality of elongated vertical compartments having substantially circular sectors in cross-section with means for progressively feeding slurried peat or the like into each of the compartments, in turn, at the top thereof, and means for progressively effecting emptying of each of the compartments at the bottom thereof after a predetermined retention time within the compartment so that as one compartment is being emptied another compartment is being filled, said solubilizer operatively connected to said for oxidizing the solubilized peat comprising means; means defining a liquid-transporting substantially vertical wave path having an inlet and an outlet, means for introducing oxygen at the bottoms of segments of the wave path, and means for exhausting off-gas from the tops of segments of the wave path so that the wave path is maintained above atmospheric pressure, said path wave inlet being connected to said solubilizer; means for circulating coolant, from an inlet around said wave path to an outlet, to remove exothermic heat while preventing mixing of the coolant and the solubilized peat or the like circulating in the wave path; means for cooling the oxidized solubilized peat to a temperature appropriate for fermentation, cooling said means connected to the wave path outlet; means for aerobically fermenting the cooled, oxidized, solubilized peat or the like to produce an off-gas including a fuel gas, said fermenting means operatively connected to said cooling means; and means for scrubbing the gas produced by said fermenting means to produce fuel gas, said scrubbing means operatively connected to said fermenting means.

2. Apparatus as recited in claim 1 wherein the outlet for said means for circulating coolant around said oxidizer is operatively connected to a flash tank, and wherein said flash tank comprises two steam outlets, one outlet connected to a compressor through a pressure control valve, and said compressor operatively connected to said steam mixer; and wherein the other outlet for steam from said flash tank also includes a pressure regulated valve, controlled by the pressure within said flash tank.

* * * * *